US010424030B2

(12) United States Patent
Ikawa et al.

(10) Patent No.: US 10,424,030 B2
(45) Date of Patent: Sep. 24, 2019

(54) EVALUATION OF DOCUMENT DIFFICULTY

(71) Applicant: INTERNATIONAL BUSINESS MACHINES CORPORATION, Armonk, NY (US)

(72) Inventors: Yohei Ikawa, Tokyo (JP); Shoko Suzuki, Tokyo (JP)

(73) Assignee: International Business Machines Corporation, Armonk, NY (US)

( * ) Notice: Subject to any disclaimer, the term of this patent is extended or adjusted under 35 U.S.C. 154(b) by 423 days.

(21) Appl. No.: 14/732,204

(22) Filed: Jun. 5, 2015

(65) Prior Publication Data

US 2016/0358275 A1 Dec. 8, 2016

(51) Int. Cl.
*G06Q 50/20* (2012.01)

(52) U.S. Cl.
CPC ..... *G06Q 50/205* (2013.01)

(58) Field of Classification Search
CPC ..... G06Q 50/205
USPC ..... 707/709
See application file for complete search history.

(56) References Cited

U.S. PATENT DOCUMENTS 6,348,805 B1 * 2/2002 Jackson ..... G01R 1/07328 324/750.16
6,549,897 B1 * 4/2003 Katariya ..... G06F 17/30616
2014/0295384 A1 * 10/2014 Nielson ..... A61B 5/162 434/157
2016/0191342 A1 * 6/2016 Kannan ..... H04L 41/5025 709/226

OTHER PUBLICATIONS

Nishihara, Y. Et al., "Information Acquiring Support System Based on Keyword Continuity and Informational Difficulty," International Conference on Human-Computer Interaction, Sep. 2005 (pp. 1-9).*
Dubay, W.H., "The Principles of Readability," Impact Information, Aug. 2004. (pp. 1-77).
Flesch, R., "A New Readability Yardstick," Journal of Applied Psychology, vol. 32, No. 3, Jun. 1948. (pp. 221-233).
Kondo, Y., et al., "Difficulty estimation of Japanese text using the textbook corpus," 14th Annual Meeting, Association for Natural Language Processing, Mar. 2008. (pp. 1113-1116).
Nakayama, Y., "An Estimation of Difficulty for Academic Books using Reviews," Japanese Society of Artificial Intelligence, Mar. 2012. (pp. 213-222).
Smith, D.R., et al., "The Lexile Scale in Theory and Practice. Final Report," Technical Report, Dec. 1988. (pp. 1-46).

* cited by examiner

*Primary Examiner* — Alford W Kindred
*Assistant Examiner* — Allen S Lin
(74) *Attorney, Agent, or Firm* — Tutunjian & Bitetto, P.C.; Vazken Alexanian

(57) ABSTRACT

A system and computer implemented method for estimating difficulty of a document includes retrieving a subject document from a storage, setting difficulty of each keyword included in the subject document to locality of the keyword in the subject document as an initial value, estimating, by a processor, difficulty of each subject document by a statistical processing of the difficulties of keywords included in the subject document, and updating the difficulty of each keyword based on the difficulty of each subject document depending on a significance value of the keyword in the subject document.

20 Claims, 16 Drawing Sheets

86a

Easy Set: Significance ($c_k$)=certain low value

| keyword | # of documents |
|---|---|
| table | 45 |
| statistics | 44 |
| sample | 44 |
| between | 43 |
| graph | 42 |
| data | 41 |
| left | 41 |
| population | 40 |
| center | 39 |
| value | 38 |
| right | 38 |
| finding | 37 |
| first | 36 |
| test | 36 |
| distribution | 34 |
| mean | 33 |
| standard | 30 |
| survey | 29 |
| random sample | 29 |
| standard deviation | 28 |
| random | 26 |

*Fig. 6*

86b

Difficult Set: Significance ($c_k$)=certain high value

| keywords | # of documents |
|---|---|
| matched | 2 ⋮ |
| false positive | 2 ⋮ |
| permutation | 2 ⋮ |
| factorial | 2 ⋮ |
| of n objects taken r at a time | 2 ⋮ |
| expected value of a | 2 ⋮ |
| discrete random variable | 2 ⋮ |
| parameters of a binomial distribution | 2 ⋮ |
| multinomial | 2 ⋮ |
| Poisson distribution | 2 ⋮ |
| Poisson | 2 ⋮ |
| of sample means | 2 ⋮ |
| continuity | 2 ⋮ |
| normal probability | 2 ⋮ |
| areas under | 2 ⋮ |
| correction for continuity | 2 ⋮ |
| for the population proportion | 2 ⋮ |
| statistical hypothesis | 2 ⋮ |
| type I error | 2 ⋮ |
| decision rule based on P-value | 2 ⋮ |
| inferential | 2 ⋮ |

*Fig. 7*

(E-1)

$$score^{(i)}(d) = ave(Difficulty^{(i)}(c_1),\ldots,Difficulty^{(i)}(c_n))$$

(E-2)

$$score^{(i)}(d) = \frac{\sum_{c \in C(d)} Difficulty^{(i)}(c)}{Length(d)}$$

(E-3)

$$score^{(i)}(d) = percentile(Difficulty^{(i)}(c_1),\ldots,Difficulty^{(i)}(c_n), th1)$$

*Fig. 9* # pseudo code for one example of significance(c|d)

```
N <- number of sentences in all contents(documents)
For each keyword c and each content d do
    N(d) <- number of sentences in the content d
    N(c) <- number of sentences that contain the keyword c
    N(c,d) <- number of sentences that contain the keyword c in the content d
    PMI(c,d) = log{N(c,d)*N/(N(c)*N(d))}
    If PMI(c,d) > 0 do
        Significance(c|d) <- PMI(c,d)
    Else do
        Significance(c|d) <- 0
    End If
End For
```

*Fig. 10*

$$PMI(c,d) = \log\left(\frac{N(c,d)}{N(c)}\right) \times \left(\frac{N}{N(d)}\right)$$

Pseudo code for one example of function f

```
C <- threshold
in i-th iteration process
    score_i(d) <- calculated in i-th process
    score_j(d) (j<i) <- already calculated in j-th process
    Difficulty_j(c) (j<i) <- already calculated in j-th process
    For each keyword c do
        If Difficulty_(i) (c) = 0
                Difficulty_(i+1) (c) <- 0
        Else do
                v0 <- 0
                v1 <- 0
                for each document d do
                        v0 <- v0 + score_i (d)*significance(c|d)
                        v1 <- v1 + significance(c|d)
                end do
                if v 0/v1 < C do
                        Difficulty_(i+1) (c) <- 0
                else do
                        Difficulty_(i+1) (c) <- v0/v1
                end if
        End If
    End For
```

*Fig. 13*

Re-ordering of Keyword Difficulty by Iteration
Top #N Difficult Keyword

Iteration=0

| | |
|---|---|
| 1 | 0 |
| 2 | run |
| 3 | predict |
| 4 | 1 |
| 5 | regression |
| 6 | equation |
| 7 | variation |
| 8 | sign |
| 9 | rank |
| 10 | line |

Iteration=1

| | |
|---|---|
| 1 | predict |
| 2 | regression |
| 3 | equation |
| 4 | coefficient |
| 5 | t |
| 6 | rank |
| 7 | difference |
| 8 | price |
| 9 | male |
| 10 | y |
| ... | |
| 19 | variation |
| 68 | line |
| 127 | 1 |
| 179 | sign |
| 192 | run |
| 217 | 0 |

*Fig. 15*

EVALUATION OF DOCUMENT DIFFICULTY

BACKGROUND

Technical Field

The present invention generally relates to evaluating difficulty of documents and particularly relates to a method, a system and a program product for calculation of difficulty of documents.

Description of the Related Art

Recently, on-line education has become popular and huge numbers of educational documents have been published and available on the on-line basis. Learners can select documents with suitable level for the learners and can study by using the selected documents. However, the huge number of educational documents available through a network makes it difficult to find the educational documents suitable for learners. This environment raises new requirements for providing a novel search technology for educational documents.

Several methods have been proposed to evaluate difficulties of documents. For example, Non-Patent Literature 1 (Smith, Dean R., et al. "The Lexile Scale in Theory and Practice. Final Report" technical report 1989, NIH Grant HD-19448, http://files.eric.ed.gov/fulltext/ED307577.pdf) discloses a three-part correlational study examining the explanatory power of the Lexile theory of reading comprehension, which is based on the semantic and syntactic components of prose. Also Non-Patent Literature 2 (Kondo, et al., "Difficulty Estimation of Japanese Text using Textbook Corpus", 14th Annual Meeting, Association for Natural Language Processing, pp. 1113-1116, March 2008, http://must.c.u-tokyo.ac.jp/nlpann/pdf/nlp2008/D5-05.pdf) discloses an estimation of difficulty of Japanese text using a textbook corpus. Furthermore, Non-Patent Literature 3 (Nakayama, et al., "An Estimation of Academic Books using Reviews", Japanese Society of Artificial Intelligence, March 2012, https://www.jstage.jst.go.jp/article/tjsai/27/3/27_3_213/_pdf) discloses a method for estimating difficulty of texts using review information provided by users.

Furthermore, Non-Patent Literature 4 (Flesch, Rudolph, "A new readability yardstick", Journal of Applied Psychology, Vol. 32(3), June 1948, pp. 221-233) discloses a method using a superficial feature of documents called "Readable score". Further, another strategy for estimating the difficulty of documents uses localities of words included therein without using labels of documents. Specifically, non-Patent Literature 5 (Nishihara, et al., "Information Acquiring Support System Based on Keyword Continuity and Informational Difficulty," International Conference on Human-Computer Interaction, September 2005, http://www.panda.sys.t.u-tokyo.ac.jp/nishihara/pdf/hci2005.pdf) discloses a method for estimating difficulty of documents using keyword continuity.

Keywords that are highly localized are identified as keywords with high difficulty in documents. However, there may be keywords which do not affect the difficulty of the documents even if the keywords are highly localized, for example, a person's name referred in a textbook of statistics. As described above, many technologies for difficulty evaluation of documents has been proposed and known. Usability, such as wide applicability of various documents, consistency and accuracy was still insufficient and a novel technique has been continuously searched and developed.

SUMMARY

An aspect of the present principles provides a method for estimating difficulties of documents accurately in any document groups without labels, which provide keys of the difficulties for documents.

According to an aspect of the present principles, the difficulty of the document is calculated by locality of keyword as the difficulty thereof and then the difficulty of the keyword is estimated using a significance of the keyword present in a particular document, thereby lowering relative difficulty of keyword that has re-estimated difficulty lower than the difficulty estimated only by the locality thereof.

According to an aspect of the present principles, a computer implemented method for estimating difficulty of a document is provided. The method comprises:

retrieving a subject document from a storage;

setting difficulty of each keyword included in the subject document to locality of the keyword in the subject document as an initial value;

estimating, by a processor, difficulty of each subject document by a statistical processing of the difficulties of keywords included in the subject document; and updating the difficulty of each keyword based on the difficulty of each subject document depending on a significance value of the keyword in the subject document.

Another aspect of the present principles, the method may comprise updating the difficulty of each subject document by using the updated difficulties of keywords included in the subject document.

Further another aspect of the present principles, the updating of the difficulty of each subject document and each keyword may be repeated until a predetermined condition is satisfied.

Still further another aspect to the present principles, the significance value may indicate an importance of the keyword in the subject document among the keywords present in the documents stored in the storage.

Yet further another aspect of the present principles, the difficulty of each keyword may be updated as a normalized sum of difficulties of subject documents including the keyword by the significance value of the keyword.

Yet further another aspect of the present principles, the significance value of each keyword may be calculated by using a formula:

$$PMI(c, d) = \log\left\{\left(\frac{N(c, d)}{N(c)}\right) \times \left(\frac{N}{N(d)}\right)\right\},$$

wherein N(c,d) is a number of sentences that contain the keyword "c" in the document "d", N(c) is a number of sentences that contain the keyword "c" in all documents in the storage, N is a number of sentences contained in all documents in the storage and N(d) is a number of sentences in the document "d".

Yet still a further aspect of the present principles, a keyword having the significance less than a predetermined threshold may be omitted from the updating of the difficulty of each keyword and the difficulty of the keyword is omitted in the updating of the difficulty of document on condition that an updated difficulty of the keyword is less than a second predetermined threshold of a function that cuts-off the updated difficulty of the keyword less than the second predetermined threshold.

Still further aspects of the present principles, a computer system and a program product including the foregoing aspects of the present principles may be provided.

BRIEF DESCRIPTION OF THE DRAWINGS

FIG. 6 shows one embodiment of data documents 86*a* stored in a significance database;

FIG. 7 shows an additional embodiment of the data documents 86*b* stored in the significance database defined as the difficult set;

FIG. 9 shows representative embodiments of a function $g_d$;

FIG. 10 shows an embodiment of a pseudo code for calculating a value of Significance(c|d) for a particular keyword "c";

FIG. 13 shows a sample pseudo code for implementing the function "f" on the computer according to an embodiment;

FIG. 15 shows an embodiment of re-ordering of the keywords by the iteration.

DETAILED DESCRIPTION OF THE EMBODIMENTS

Figure 1:
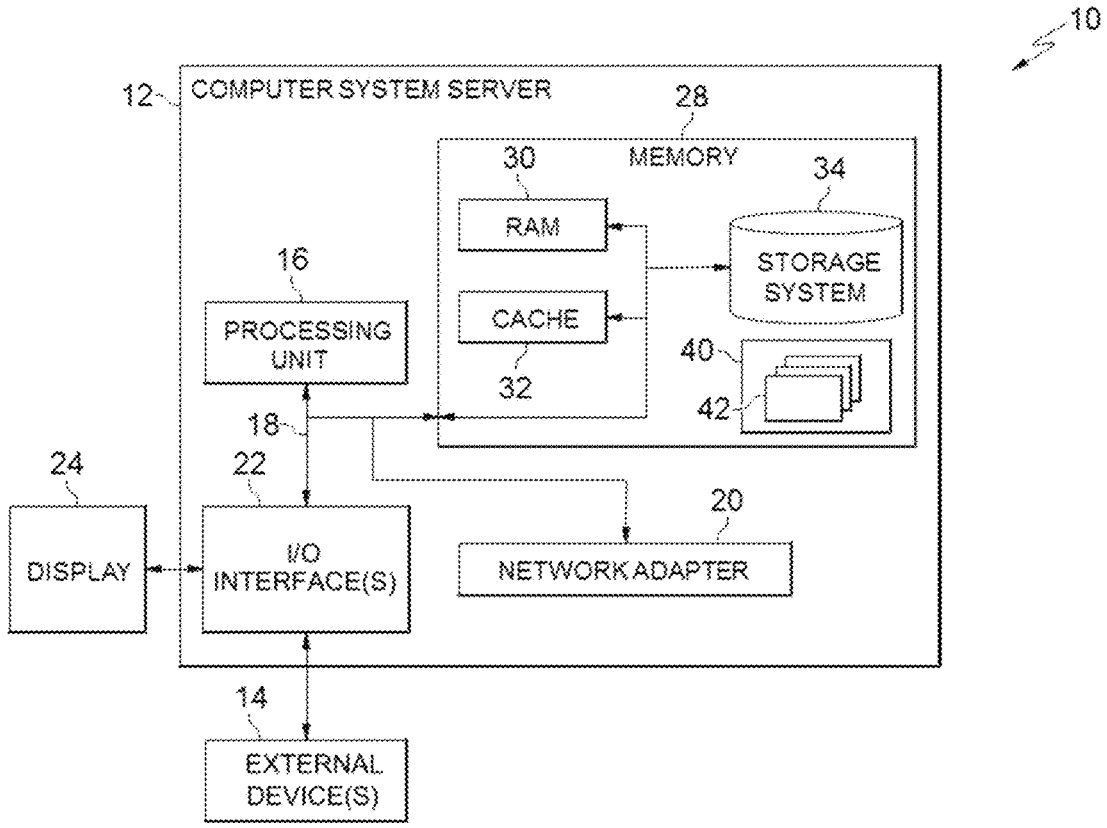
FIG. 1 shows an embodiment of a schematic of an example of a cloud computing node.

The present principles will be explained using particular embodiments associated with the drawings. It should be understood in advance that although this disclosure includes a detailed description on cloud computing, implementation of the teachings recited herein are not limited to a cloud computing environment. Rather, embodiments of the present principles are capable of being implemented in conjunction with other types of computing environments now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources, but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service ("SaaS"): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure, including network, servers, operating systems, storage, or even individual application capabilities, with the possible exception of limited user-specific application configuration settings.

Platform as a Service ("PaaS"): the capability provided to the consumer is to deploy onto the cloud infrastructure consumer-created or acquired applications created using programming languages and tools supported by the provider. The consumer does not manage or control the underlying cloud infrastructure, including networks, servers, operating systems, or storage, but has control over the deployed applications and possibly application hosting environment configurations.

Infrastructure as a Service ("IaaS"): the capability provided to the consumer is to provision processing, storage, networks, and other fundamental computing resources where the consumer is able to deploy and run arbitrary software, which can include operating systems and applications. The consumer does not manage or control the underlying cloud infrastructure, but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Referring now to FIG. 1, a schematic of an example of a cloud computing node is shown. Cloud computing node 10 is only one example of a suitable cloud computing node and is not intended to suggest any limitation as to the scope of use or functionality of embodiments of the invention described herein.

Regardless, cloud computing node 10 is capable of being implemented and/or performing any of the functionality set forth hereinabove. In cloud computing node 10 there is a computer system/server 12, which is operational with numerous other general purpose or special purpose computing system environments or configurations.

Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture ("ISA") bus, Micro Channel Architecture ("MCA") bus, Enhanced ISA ("EISA") bus, Video Electronics Standards Association ("VESA") local bus, and Peripheral Component Interconnects ("PCI") bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory ("RAM") 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (e.g., at least one) of program modules 42, may be stored in memory 28 by way of example, and not limitation, as well as an operating system, one or more application programs, other program modules, and program data. Each of the operating systems, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, one or more devices that enable a user to interact with computer system/server 12, and/or any devices (e.g., network card, modem, etc.) that enable computer system/server 12 to communicate with one or more other computing devices. Such communication can occur via Input/Output ("I/O") interfaces 22. Still yet, computer system/server 12 can communicate with one or more networks such as a local area network ("LAN"), a general wide area network ("WAN"), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples include, but are not limited to, microcode, device drivers, redundant processing units, external disk drive arrays, RAID systems, tape drives, and data archival storage systems, etc.

Figure 2:
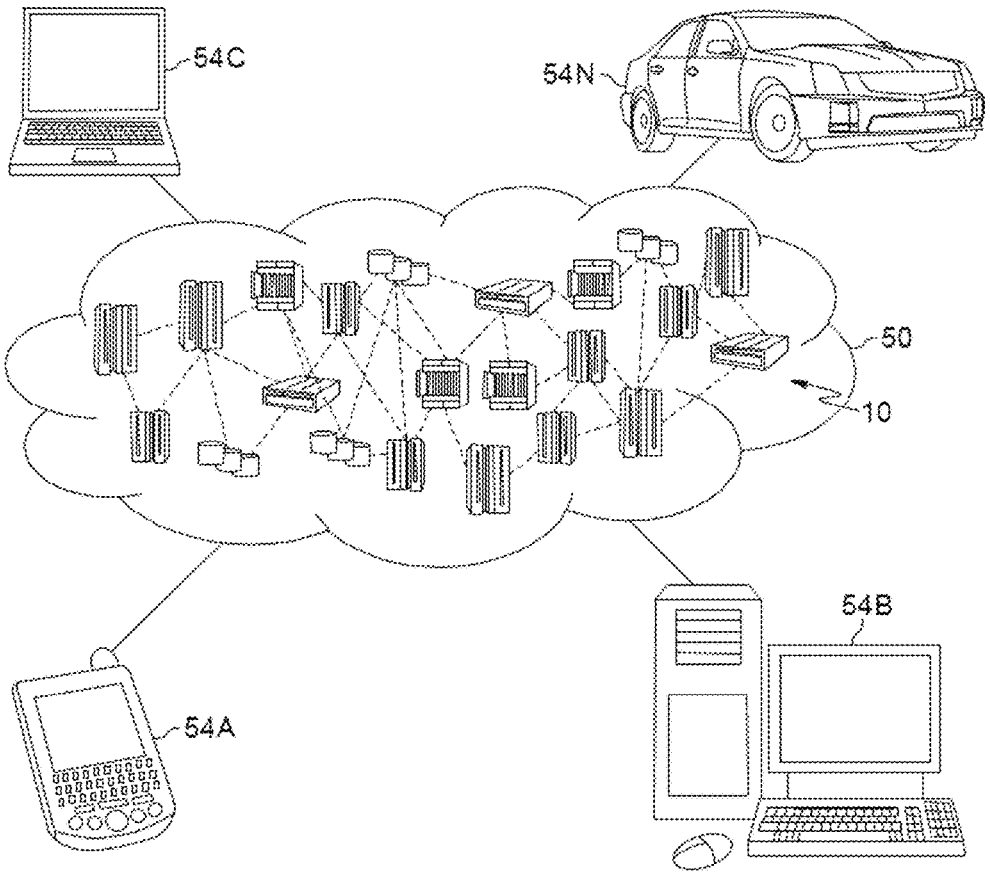
FIG. 2 shows an embodiment of an illustrative cloud computing environment 50.

Referring now to FIG. 2, illustrative cloud computing environment 50 is depicted. As shown, cloud computing environment 50 comprises one or more cloud computing nodes 10 with which local computing devices used by cloud consumers, such as, for example, personal digital assistant ("PDA") or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It should be understood that the types of computing devices 54A-N shown in FIG. 2 are intended to be illustrative only and that computing nodes 10 and cloud computing environment 50 can communicate with any type of computerized device over any type of network and/or network addressable connection (e.g., using a web browser).

Figure 3:
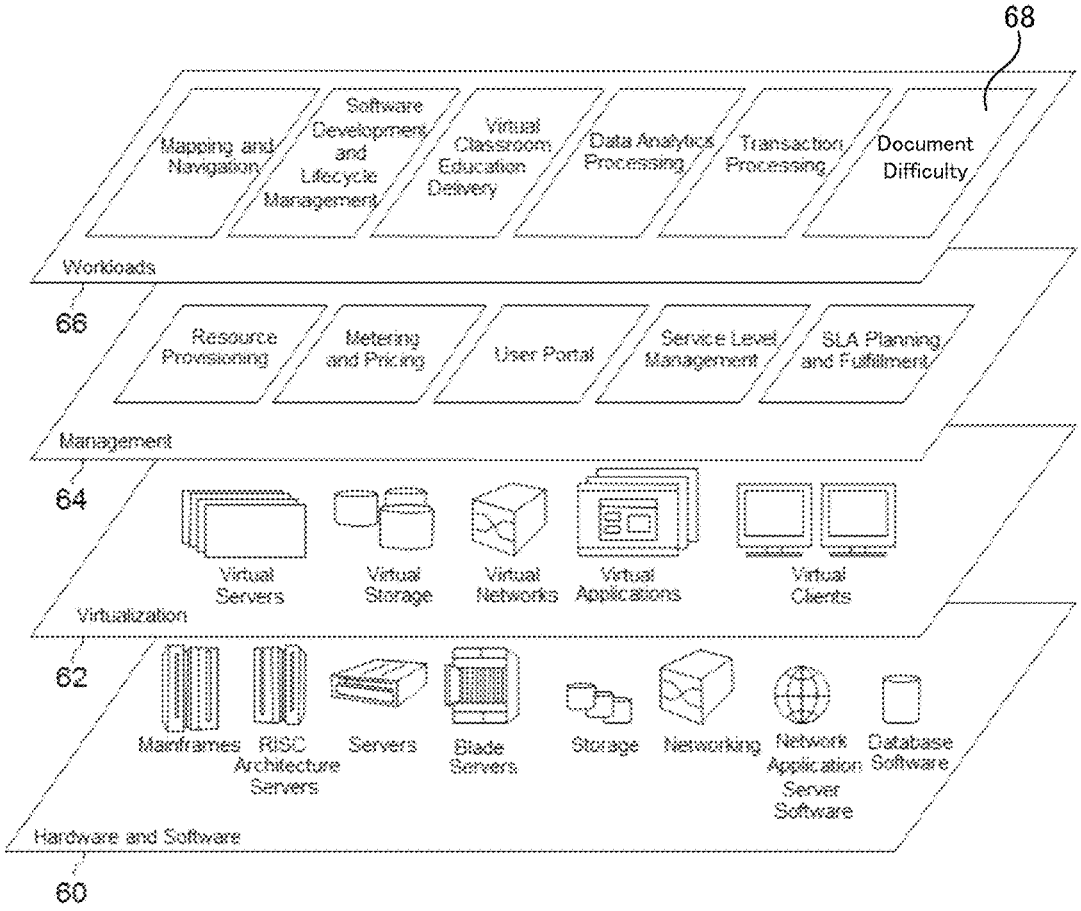
FIG. 3 shows an embodiment of a set of functional abstraction layers provided by cloud computing environment 50 (shown in FIG. 2)

Referring now to FIG. 3, a set of functional abstraction layers provided by cloud computing environment 50 (FIG. 2) is shown. It should be understood in advance that the components, layers, and functions shown in FIG. 3 are intended to be illustrative only and embodiments of the invention are not limited thereto. As depicted, the following layers and corresponding functions are provided:

Hardware and software layer 60 includes hardware and software components. Examples of hardware components include: mainframes; Reduced Instruction Set Computer ("RISC") architecture based servers; storage devices; networks and networking components. In some embodiments, software components include network application server software.

Virtualization layer 62 provides an abstraction layer from which the following examples of virtual entities may be provided: virtual servers; virtual storage; virtual networks, including virtual private networks; virtual applications and operating systems; and virtual clients.

In one example, management layer 64 may provide the functions described below. Resource provisioning provides dynamic procurement of computing resources and other resources that are utilized to perform tasks within the cloud computing environment. Metering and Pricing provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal provides access to the cloud computing environment for consumers and system administrators. Service level management provides cloud computing resource allocation and management such that required service levels are met. Service Level Agreement ("SLA") planning and fulfillment provides prearrangement for, and procurement of, cloud computing resources for which a future requirement is anticipated in accordance with an SLA.

Workloads layer 66 provides examples of functionality for which the cloud computing environment may be utilized. Examples of workloads and functions which may be provided from this layer include: mapping and navigation; software development and lifecycle management; virtual classroom education delivery; data analytics processing; transaction processing; and difficulty evaluation of documents 68 of the present invention.

Figure 4:
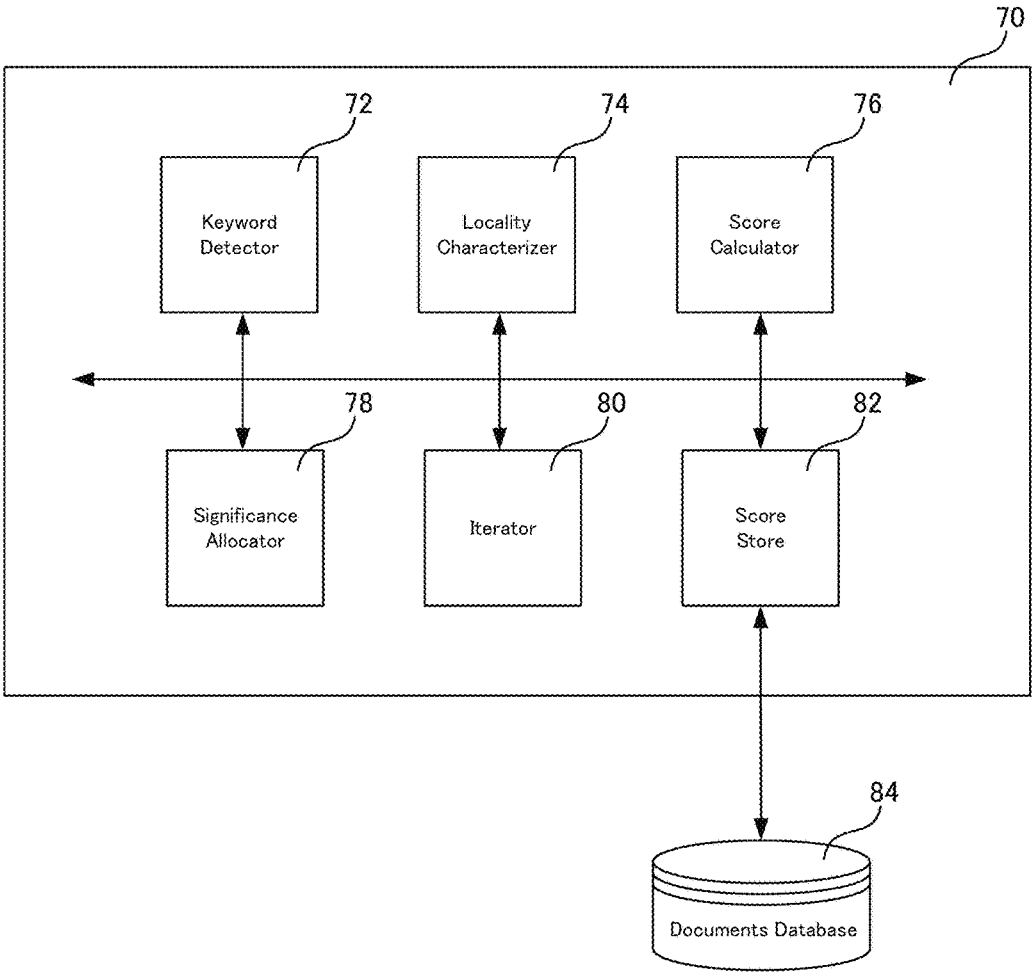
FIG. 4 shows an embodiment of a functional block diagram 70 implemented on the computer.

Hereafter, the present principles will be detailed using particular embodiments for making easy to understanding the present invention. FIG. 4 shows a functional block diagram 70 implemented on the computer and the functional block 70 comprises a keyword detector 72, a locality characterizer 74 and a score calculator 76. The keyword detector 72 retrieves documents from a document database 84 which stores educational, news, and/or story documents to be processed by the present system and detects keywords included in the documents in the document data base as well as the keywords included in a particular document by a conventional text search technology. The locality characterizer 74 counts the same keyword detected by the keyword detector for each of documents and for all of the documents in the document database 84 and determines the locality of the keywords, i.e., Locality(c) by using appearance frequency of the same keyword in a particular document. Here the letter "c" in the parenthesis denotes the keyword present in a particular document. Also the keyword detector 72 counts the same keyword in all of the documents stored in the document database 84 for determining a significance of the keyword present in the particular document.

In one embodiment, the locality of the keyword can be determined simply by 1/(appearance frequency) such that a localized keyword has a high value. Alternatively, the locality reported, as disclosed in Non-Patent Literature 5, can be used as the indicator of the locality. In one embodiment, the difficulty of the keyword is represented by the locality of the keyword "c", i.e., $\text{Difficulty}^{(0)}(c)=\text{Locality}(c)$ as the initial setting. The suffix (i) denotes the cycle number of the iteration.

The score calculator 76 calculates a score of difficulty of document "d", i.e., $\text{score}^{(i)}(d)$ by using the $\text{Difficulty}^{(i)}(c_k)$, where $c_k$ represents any keyword in the document "d". The $\text{Difficulty}^{(i)}(c_k)$ is refined by an iterator 80 by a significance of the keyword and the refined $\text{Difficulty}^{(i+1)}(c_k)$ can be used for the next refined $\text{score}^{(i+1)}$ of the document. Thus, the next $\text{score}^{(i+1)}$ is refined by the significance of the keyword together with the locality of the keyword in the particular document. Note that the difficulty of the keyword should be referred to the term "$\text{Difficulty}^{(i)}(c_k)$" and the difficulty of the document should be referred to the term "$\text{score}^{(i)}(d)$". In an embodiment, the $\text{score}^{(i)}(d)$ can be calculated by statistical processing of the parameter $\text{Difficulty}(c_k)$s using formula (1):

$$\text{score}^{(i)}(d)=g_d(\text{Difficulty}^{(i)}(c_1), \ldots ,\text{Difficulty}^{(i)}(c_n)) \quad (1)$$

In formula (1), "i" is a non-negative integer indicating the iteration cycle number; $g_d$ is a statistical function of $\text{Difficulty}^{(i)}(c_k)$; and n is a positive integer indicating a keyword number in the subject document. According to one embodiment of the present principles, the difficulty of the document is modified by the significance of the keyword over the documents stored in the document database 84 so as to improve difficulty estimation by the iteration. The calculations of the iteration cycle and the $\text{score}^{(i)}(d)$ will be described hereinafter.

The functional block 70 further comprises a significance allocator 78, an iterator 80 and a score store 82. The significance allocator 78 allocates the significance $(c_k|d)$ of the keyword in the documents and the significance value indicates importance of the keyword "$c_k$" in the subject document "d" of all documents in the document database 84.

The iterator 80 refines or updates the value of $\text{Difficulty}^{(i)}(c_k)$ using the significance of the keyword. The iterator 80 computes the refined $\text{Difficulty}^{(i+1)}(c_k)$ using the values of $\text{Significance}(c_k|d)$ and start next iteration cycle using the refined $\text{Difficulty}^{(i+1)}(c_k)$ to obtain the refined the $\text{score}^{(i+1)}(d)$. The refinement of the $\text{Difficulty}^{(i)}(c_k)$ is performed by using the following formula (2) and the refined value is set as the refined value of $\text{Difficulty}^{(i+1)}(c_k)$.

$$Difficulty^{(i+1)}(c_k) = \frac{\sum_d score^{(i)}(d) \times \text{Significance}(c_k \mid d)}{\sum_d \text{Significance}(c_k \mid d)} \quad (2)$$

In formula (2), the summation is performed over the documents stored in the documents database 84.

The parameter Significance($c_k$|d) in formula (2) characterizes importance of the keyword "c" in the document "d" among the documents in the document database 84 and the detail of the iteration and the refine of Difficulty$^{(i)}$($c_k$), and can be provided as described below.

In an embodiment, the value of Significance(c|d) may provide a role for filtering the keyword with less importance for the document, i.e., popularity of the keyword in the documents in the document database 84. In a particular example, the Significance(c|d) can be the value of PMI(c,d) if the value of PMI(c,d) has positive value and the value of Significance(c|d) becomes zero if the value of PMI(c,d) is less than zero (0) when the threshold=0 is used. Depending on the particular application, different thresholds may be allowed so far as the filtering of the keyword may be possible.

PMI(c,d) is defined by formula (3):

$$PMI(c, d) = \log\left\{\left(\frac{N(c, d)}{N(c)}\right) \times \left(\frac{N}{N(d)}\right)\right\} \tag{3}$$

In formula (3), N(c,d) is a number of sentences that contain the keyword "c" in the document "d"; N(c) is a number of sentences that contain the keyword "c" in all documents in the document database 84; N is a number of sentences contained in all documents in the document database 84 and N(d) is a number of sentences in the document "d".

When the keyword "c" is more significant or localized in the document "d", the value of PMI(c,d) becomes larger and larger. The negative value of PMI(c,d) means that such keyword "c" may be substantially of no importance or popularity in the documents stored in the document database 84 and can be allowed as noises even when the locality in the subject document is high.

In a further simplified embodiment, the significance value may be determined as Significance($c_k$|d)=N(c,d) depending on particular characteristics of documents. Further in another embodiment, Significance($c_k$|d)=N(c,d)/N(d) may be possible depending on a particular application or characteristics of categories of documents. The parameter Significance($c_k$|d) will be detailed later using a sample pseudo code.

The score store 82 receives the refined score$^{(i+1)}$(d) and stores the value to the documents database 84 with associating the value to the corresponding documents. In this embodiment, the difficulty of the document score$^{(i)}$(d) can be estimated by the locality of the keyword and the difficulty of the document is refined by characteristics of the keyword among the documents such that the difficulty of the document can be obtained without other information. And further, the present principles provide a method for estimating difficulties of documents accurately and effectively by a few iterations for Difficulty refinement in any document groups without labels, which provide keys of the difficulties for documents. According to a further embodiment, the difficulty of the document is refined by the refined difficulty of the keyword such that the difficulty can be obtained without other information than the documents.

Figure 5:
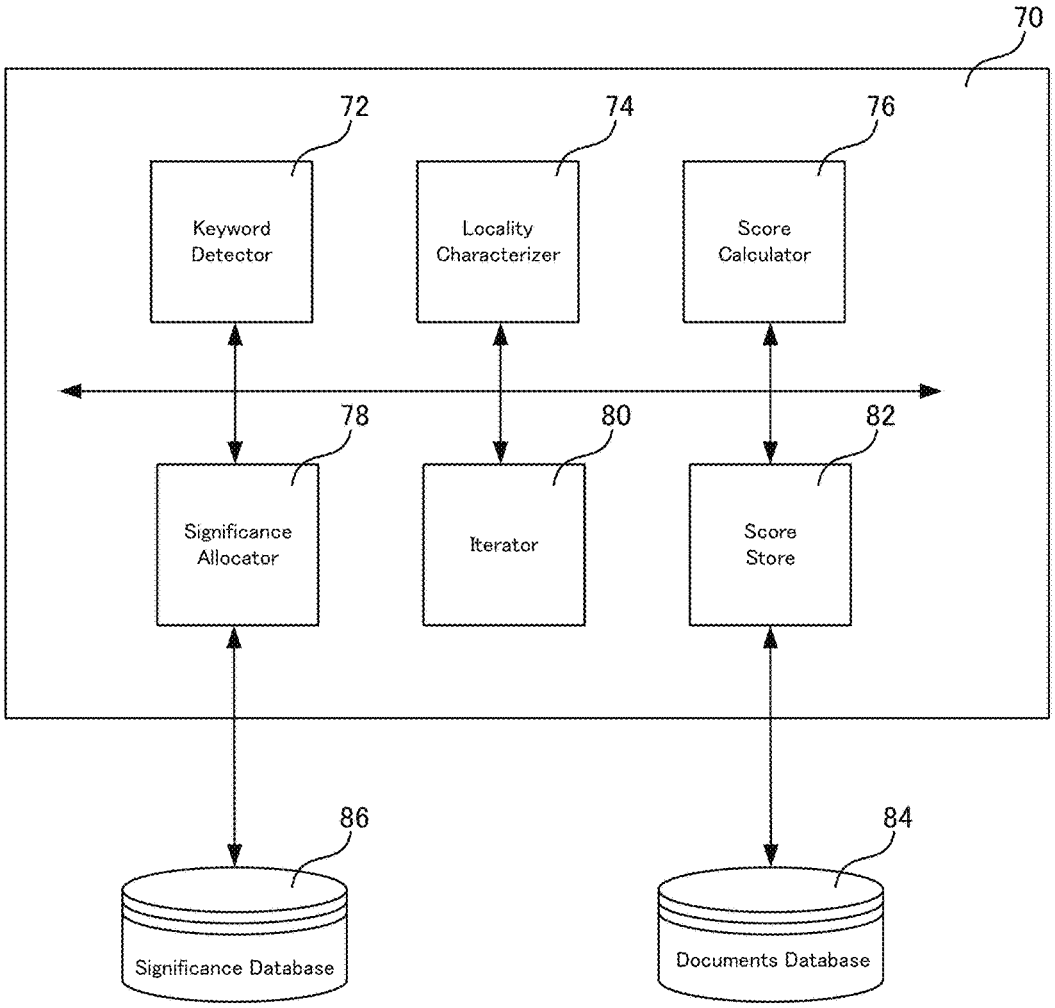
FIG. 5 shows an embodiment of another embodiment of the functional block implemented on the computer.

FIG. 5 shows another embodiment of the functional block 70 implemented on the computer. The embodiment shown in FIG. 5 comprises the same functional modules as described in FIG. 4 except for the significance database 86. The significance database 86 reserves typical significance values of keywords obtained from the extensive analysis of documents and/or documents available in the network. The significance database 86 provides the value of Significance ($c_k$|d) to the significance allocator 78 for the computation of the iterator 80 in response to a request of the significance allocator 78. This particular embodiment can be useful for addressing huge amounts of requests for estimation of the difficulty of document score$^{(i)}$(d) because the necessity for "on-the-fly" computations of the significance values can be replaced by the database access using the keywords as the access key.

FIG. 6 shows one embodiment of the data documents 86*a* stored in the significance database. The embodiment shown in FIG. 6 is the "easy set". The term "easy set" means that the keyword listed therein may be easy in understanding or simple in the concept thereof. In the embodiment illustrated in FIG. 6, the significance allocator 78 retrieves the certain low value allocated to the keyword listed in the left column using the detected keyword in the subject documents. The right column lists the number of documents including the corresponding keyword in the left column.

FIG. 7 shows an additional embodiment of the data documents 86*b* stored in the significance database defined as the "difficult set". The term "difficult set" means that the keyword listed therein may be difficult in understanding the concept thereof or long and/or collocation. In the embodiment illustrated in FIG. 7, the significance allocator 78 retrieves the certain high value allocated to the keyword listed in the left column using the detected keyword in the subject documents.

Figure 8:
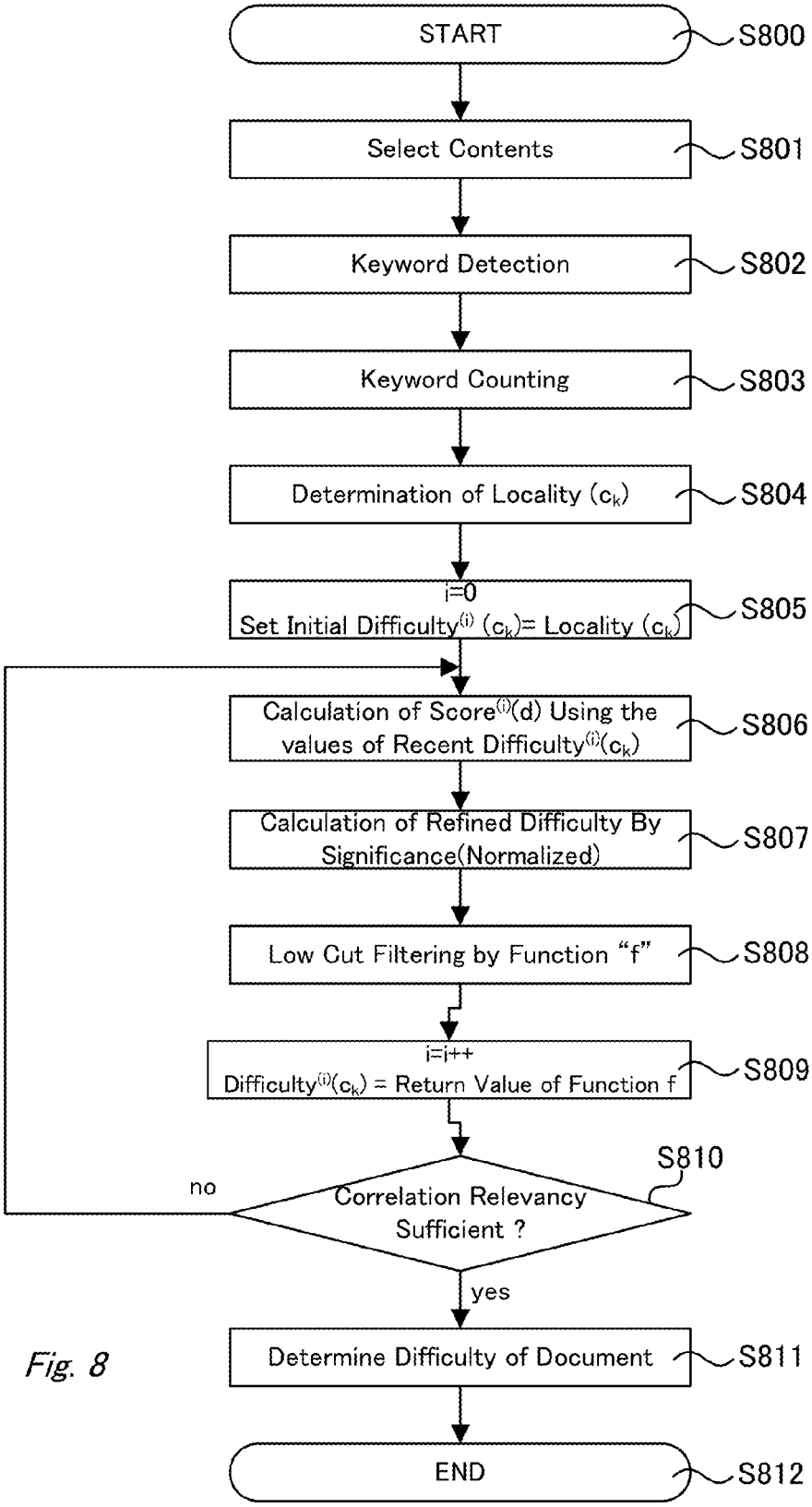
FIG. 8 shows a flowchart of a method implemented on the computer according to one embodiment

FIG. 8 shows a flowchart of a method implemented on the computer according to one embodiment. The method starts from step S800 and in step S801, the keyword detector 72 selects and retrieves the document to be subjected for detection from the documents database 84. Then in step S802, the keyword detector 72 detects the keywords in the subject documents. The locality characterizer 74 counts the detected keywords in step S803 in the subject document as well as the documents in the documents database 84 for computing Significance($c_k$|d).

Then in step S804, the locality characterizer 74 provides the Locality($c_k$) depending on the appearance frequency. Then in an embodiment, the high value of Locality is assumed to be difficult and for initial setting, the score calculator 76 sets the initial Difficulty$^{(0)}$($c_k$)=Locality($c_k$) in step S805. Also in step S805, the iteration cycle number "i" is initialized to be zero (0).

Then, in step S806, the score calculator 76 calculates the initial difficulty for the document "d", i.e., score value score$^{(0)}$(d) (i=0) using the values of Difficulty$^{(0)}$($c_k$) using, formula (1) described above.

Now, referencing to FIG. 9, representative embodiments of the function $g_d$ will be explained. In embodiment (E-1), the function $g_d$ is the function "average". In the embodiment (E-2), the function $g_d$ is a ratio of the total difficulty of the keywords to the length of documents. In the third embodiment (E-3), the function $g_d$ is the function "percentile" that returns the value of Difficulty$^{(i)}$ over a predetermined threshold value "th1". Other embodiments may be adopted as far as meaningful score values calculated. All of the above embodiments can provide the difficulty of the document as a statistically plausible one without depending on particular difficulty of the keyword and the embodiments may be adopted depending on particular characteristics of the documents.

Here, again referring to FIG. 8, in step S807, the iterator 80 calculates refined Difficulty by using significance value using the above described formula (2). FIG. 10 shows an embodiment of the pseudo code for calculating the value of Significance(c|d) for particular keyword "c". The processing of the pseudo code of FIG. 10 cuts the contributions of keywords having lower Significance($c_k$|d) on the difficulty of the document "d". The definition of Significance($c_k$|d) has already been described above using the formula (3) and now Significance($c_k$|d) in the embodiments will be further described using FIG. 11. The process of step S807 can be interpreted such that the difficulty of the subject document previously determined by the localities of keywords is replaced with the difficulty of document taking into account the significance of the keyword present in the document among all documents in the document database 84.

Figure 11:
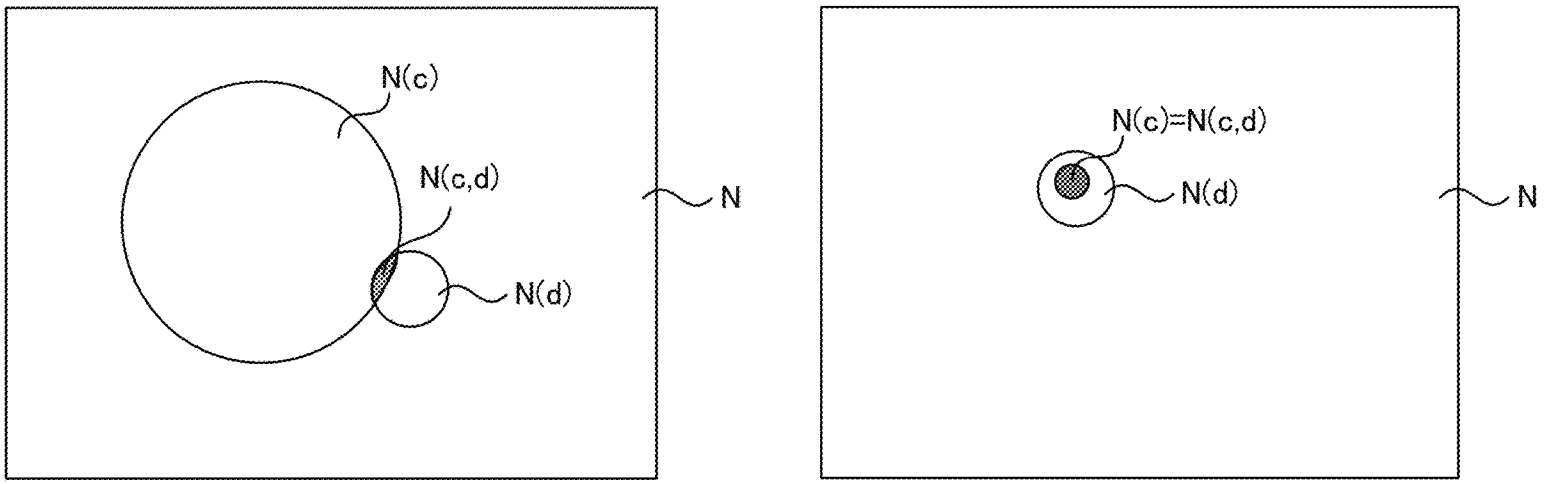
FIG. 11 illustrates a characteristic of particular keyword "c" in all of the documents in the document database 84 and the keyword "c" in a particular document according to an embodiment.

FIG. 11 illustrates a characteristic of particular keyword "c" in all of the documents in the document database 84 and the keyword "c" in a particular document. Here, it is assumed that the document database 84 contains total N sentences and the areas of the rectangular and circular shapes correspond to the numbers of sentences. Among the total N sentences, N(c) sentences include the keyword "c" and the subject document contains N(c,d) sentences which include the keyword "c". In the case of FIG. 11(*a*), the keyword "c" is not so significant for the documents in the document database 84. In the case of FIG. 11(*a*), the value of {N(c, d)/N(c)}<<1 and the value {N/N(d)}>>1. Contradictory to this, the case shown in FIG. 11(*b*) illustrates that the keyword "c" is present only in the subject document "d" and the value of {N(c, d)/N(c)}=1 and the value {N/N(d)}>>1.

Thus, in the case shown in FIG. 11, the PMI value is larger in case 11(*b*) than that of case 11(*a*). In the case of {N(c, d)/N(c)}<<{N/N(d)}, the Significance($c_k$|d) for the keyword "c" of the document "d" in case 11(*a*) will be set to zero as described in FIG. 10. In turn for case 11(*b*), the keyword "c" in the document "d" is just significant in the document "d" such that the PMI value of log {N/N(d)} is set as the Significance($c_k$|d). In summary, the Significance($c_k$|d) in the present embodiments represent relative importance of the keyword "c" in the document "d" within all documents in the document database 84 as discussed above and the estimation of Significance($c_k$|d) will refine the keyword difficulty.

Figure 12:
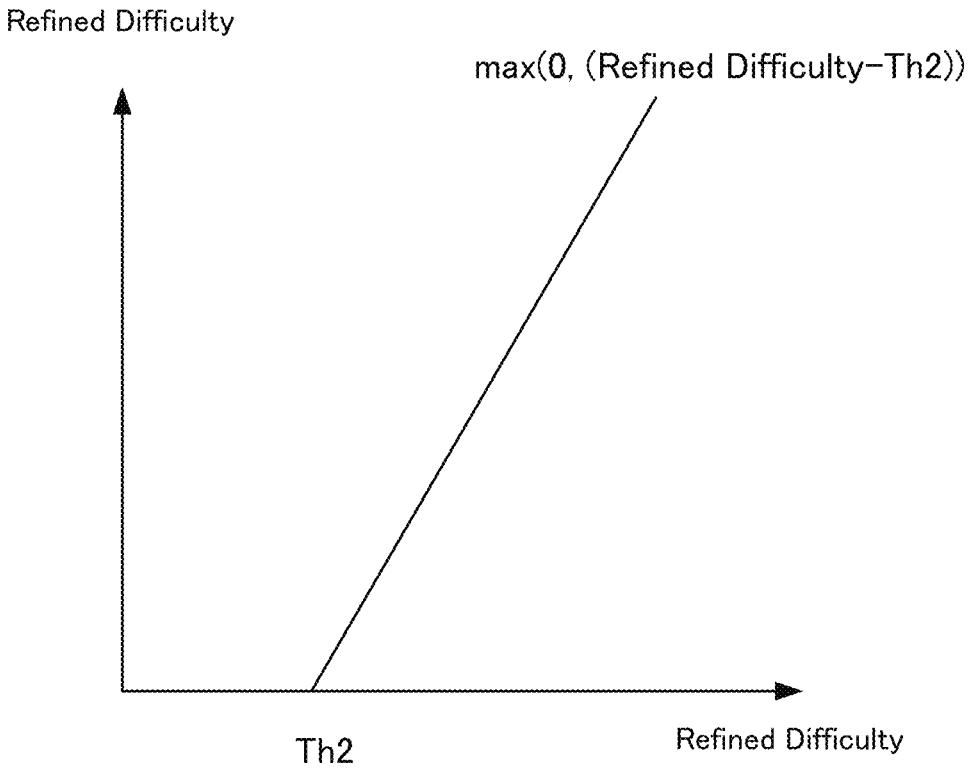
FIG. 12 shows an exemplary function of a function "f" according to an embodiment

Again referencing to FIG. 8, the iterator 80 in step S808 filters the value of Difficulty given by formula (2) using the function "f" of which function is representatively shown in FIG. 12. The function "f" cuts the Difficulty smaller than Th2 by returning zero value while returning the value of Difficulty obtained by formula (2) when the value is not less than Th2. This process can omit the contribution of the popular keywords in the document database 84 to the value of refined Difficulty in the iterative refinement of the difficulty of the document. The returned value of the function "f" is set in step S809 as the recent difficulty value $\text{Difficulty}^{(i)}(c_k)$ used for the next iteration cycle for calculating the $\text{score}^{(i)}(c_k)$, i.e., the difficulty of the document in formula (1).

FIG. 13 shows a sample pseudo code for implementing the function "f" on the computer which has an equivalent function to the "hinge" function of FIG. 12. Note that the variable C denotes the threshold, i.e., Th2, and difficulty_i(c) denotes the $\text{Difficulty}^{(i)}(c)$ of the $i^{th}$ iteration cycle.

Next, the iterator 80 determines whether or not the correlation relevancy reaches to particular sufficient level in step S810. Here, the above correlation relevancy denotes a target level such as a correlation coefficient between the difficulty and keywords provided in a particular embodiment Spearman correlation coefficient. If correlation relevancy is not sufficient level (i.e., no), the iterator 80 reverts to step S806 and performs the next iteration calculation. If the correlation relevancy becomes a sufficient level (i.e., yes), the iterator 80 determines the difficulty level of the document to be the recent $\text{score}^{(i)}(d)$ value and stores the value in the documents database 84 in association with the documents identifier in step S811. Then the method is terminated in step S812.

In an embodiment, termination of the iteration can be determined when top N difficult keywords becomes unchanged and/or the correlation of the keyword meaning and a predetermined difficulty level template for meanings reaches a sufficient level. Another method for terminating the iteration may be useful depending on particular applications.

Herein below, the present principles will be explained by using particular example. In this example, the experimental data was selected from a textbook and it was assumed that each of the sections in the textbook were independent documents. Also it was assumed that the difficulty of the section, i.e., documents, became more difficult from the first section to the latter sections as to rank the difficulties of the sections.

The score(d) of the sample documents were calculated by using Equation (E-2) by which the score value was obtained as the ratio of the total difficulty of the keywords to the length of the documents. The evaluation of the ranking of the difficulty was performed by a Spearman correlation coefficient for the evaluated difficulties and the assumed difficulties of the sections.

The experimental condition was as follows:

Computer: Thinkpad™ x230

CPU: Intel Core™ i5-3320 with clock cycle of 2.60 GHz

Memory: 8 GB

Programming language: Java™

Figure 14:
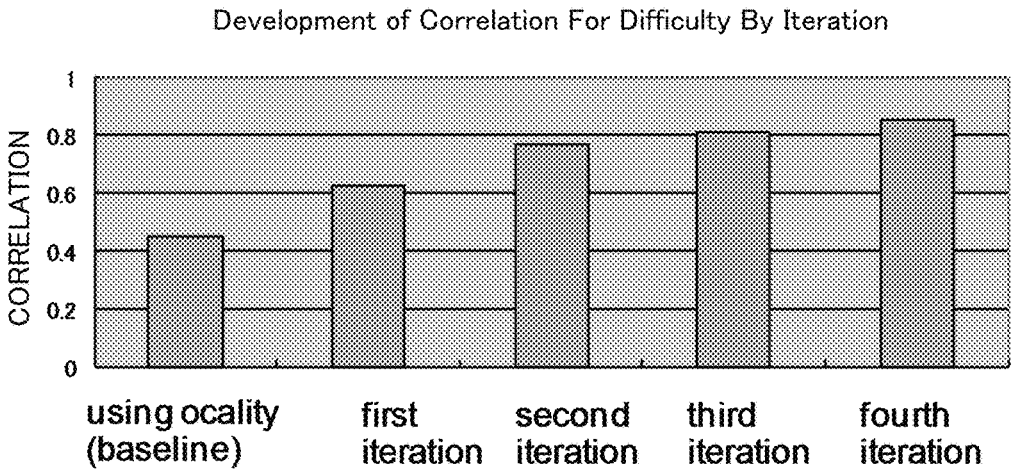
FIG. 14 shows results of the computer implementation of the program of an embodiment of the present principles.

The results are shown in FIG. 14 and in FIG. 14, the ordinate represents the Spearman correlation coefficient, and the abscissa represents iteration cycle number. As shown in FIG. 14, the Spearman correlation factors become high with respect to the iteration cycle number. The correlation coefficients tend to become higher with respect to the iteration. However, the first iteration could provide almost sufficient relevancy to the assumed difficulty and therefore, it is concluded that a few iterations may be required to provide good evaluation of the documents' difficulty.

FIG. 15 shows re-ordering of the keywords by the iteration. The example is shown using the result after the one iteration. The keyword order prior to the iteration includes two numerals without any difficulty. However, the result after the iteration of one time includes no numeral and relatively long and complicated keywords are ranked at the upper level. As shown in FIG. 15, at least one iteration improves the evaluation of keyword difficulties and then improves evaluation of difficulty of documents.

Figure 16:
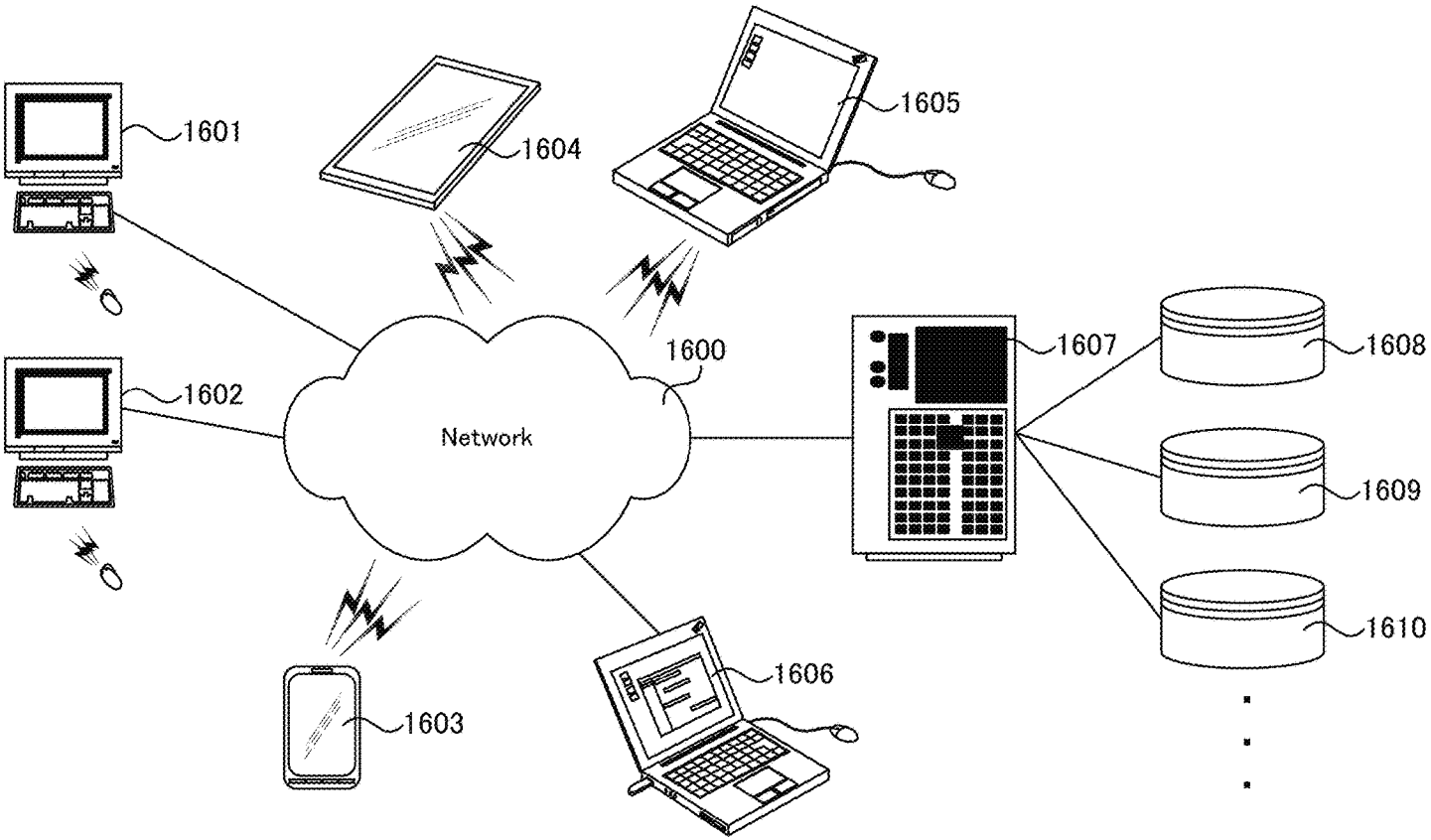
FIG. 16 shows an exemplary implementation of the computer system according to an embodiment.

An exemplary implementation of the computer system will be explained by using the illustrations depicted in FIG. 16. The system comprises the network 1600 and a plurality of client apparatuses including desktop computers 1601, 1602, notebook computers 1605, 1606, tablet type computer 1604, and smartphone 1603, each of which is connected by a wired and/or wireless transmission protocol. The client apparatus can include a so-called personal data assistant ("PDA").

To the network 1600, server computer 1607 is connected and the server computer 1607 stores documents provided with the difficulty level according to the present principles. The server computer 1607 can run the program codes of the present principles on an appropriate operating system ("OS") such as Z/Architecture™ for a main frame computer, Linux™, Unix™ or Windows™ depending on the particular implementation of the apparatus. The program of the present principles may be written by appropriate programming languages such as C, C++, C# etc., depending on the OS.

Also the server computer 1607 can be implemented by using a hypervisor architecture which can make different operating systems run on the server computer 1607. The server computer 1607 can receive requests from the client apparatuses for browsing and/or downloading documents stored in the documents databases 1608, 1609, and 1610.

The documents databases 1608-1610 can be implemented for each of documents providers and can store the documents to which the difficulty levels have been allocated thereto beforehand to the client access rather than "on-the fly" difficulty allocation. The documents of the databases can be searched by difficulty levels of the documents as well as keywords included in each of the documents.

When a particular client apparatus, such as the tablet type computer 1604, sends a request for browsing documents using keywords and/or difficulty levels etc., for example, education documents, the server computer 1607 searches the documents and returns the searched results to the tablet type computer 1604 as the response thereof. The user of the tablet type computer 1604 can browse and/or download the searched documents on the display device so as to satisfy his or her purpose with respect to the difficulties of the documents.

The present principles may be a system, a method, and/or a computer program product. The computer program product may include a computer readable storage medium (or media) having computer readable program instructions thereon for causing a processor to carry out aspects of the present principles.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory ("RAM"), a read-only memory ("ROM"), an erasable programmable read-only memory ("EPROM" or Flash memory), a static random access memory ("SRAM"), a portable compact disc read-only memory ("CD-ROM"), a digital versatile disk ("DVD"), a memory stick, a floppy disk, a mechanically encoded device such as punch-cards or raised structures in a groove having instructions recorded thereon, and any suitable combination of the foregoing.

A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture ("ISA") instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network ("LAN") or a wide area network ("WAN"), or the connection may be made to an external computer (for example, through the Internet using an Internet Service Provider). In some embodiments, electronic circuitry including, for example, programmable logic circuitry, field-programmable gate arrays ("FPGA"), or programmable logic arrays ("PLA") may execute the computer readable program instructions by utilizing state information of the computer readable program instructions to personalize the electronic circuitry, in order to perform aspects of the present principles.

Aspects of the present principles are described herein with reference to flowchart illustrations and/or block diagrams of methods, apparatus (systems), and computer program products according to embodiments of the invention. It should be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present principles. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components and/or groups thereof.

The corresponding structures, materials, acts, and equivalents of all means or step plus function elements in the claims below, if any, are intended to include any structure, material, or act for performing the function in combination with other claimed elements as specifically claimed. The description of one or more aspects of the present principles has been presented for purposes of illustration and description, but is not intended to be exhaustive or limited to the invention in the form disclosed.

The descriptions of the various embodiments of the present principles have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The invention claimed is:

1. A computer implemented method for using an electronic document retrieval system to retrieve electronic documents having a level of difficulty in satisfaction of an electronic document retrieval request, comprising:

retrieving at least one subject document from electronic documents stored in a storage;

setting a difficulty of each keyword included in the at least one subject document equal to a locality of the keyword in the at least one subject document as an initial value;

estimating a difficulty of the at least one subject document by a statistical processing of the difficulties of the keywords included in the at least one subject document;

calculating a significance value of each keyword in the at least one subject document, wherein the significance value of a given keyword is calculated by using a formula based at least on a number of sentences that contain the given keyword in the at least one subject document, a number of sentences in the at least one subject document, a number of sentences contained in all of the electronic documents stored in the storage, and a number of sentences that contain the given keyword in all of the electronic documents stored in the storage;

updating the difficulty of each keyword based on the difficulty of the at least one subject document depending on the significance value of the keyword in the at least one subject document; and receiving, from a computer device over a network, a request for electronic documents based on at least one of keywords and difficulty, retrieving one or more results including one or more electronic documents in satisfaction of the request, and transmitting the retrieved results to the computing device;

wherein the steps of the method are implemented by at least one processor operatively coupled to a memory.

2. The computer implemented method of claim 1, further comprising updating the difficulty of each subject document by using the updated difficulties of keywords included in the subject document.

3. The computer implemented method of claim 2, wherein updating the difficulty of each subject document and each keyword is repeated until a predetermined condition is satisfied.

4. The computer implemented method of claim 2, wherein the difficulty of the keyword is omitted in the updating of the difficulty of each subject document on condition that an updated difficulty of the keyword is less than a second predetermined threshold of a function that cuts-off the updated difficulty of the keyword less than the second predetermined threshold.

5. The computer implemented method of claim 1, wherein the significance value indicates an importance of the keyword in the at least one subject document among the keywords present in the electronic documents stored in the storage.

6. The computer implemented method of claim 5, wherein a keyword having the significance less than a predetermined threshold is omitted from the updating of the difficulty of each keyword.

7. The computer implemented method of claim 1, wherein the difficulty of each keyword is updated as a normalized sum of difficulties of subject documents including the keyword by the significance value of the keyword.

8. The computer implemented method of claim 1, wherein the formula used to calculate the significance value of the given keyword is:

$$PMI(c, d) = \log\left\{\left(\frac{N(c, d)}{N(c)}\right) \times \left(\frac{N}{N(d)}\right)\right\},$$

wherein c is the given keyword, d is the at least one subject document, N(c,d) is the number of sentences that contain the given keyword in the at least one subject document, N(c) is the number of sentences that contain the given keyword in all of the electronic documents stored in the storage, N is a number of sentences contained in all of the electronic documents stored in the storage and N(d) is a number of sentences in the at least one subject document.

9. A computer system comprising a processor configured to execute program codes for using an electronic document retrieval system to retrieve electronic documents having a level of difficulty in satisfaction of an electronic document request, a memory configured to tangibly store the program codes for execution of the program codes by the processor, and a storage device configured to store electronic documents, the processor further configured to execute the program codes to:

retrieve at least one subject document from electronic documents stored in a storage;

set a difficulty of each keyword included in the at least one subject document equal to a locality of the keyword in the at least one subject document as an initial value;

estimate a difficulty of the at least one subject document by a statistical processing of the difficulties of the keywords included in the at least one subject document;

calculate a significance value of each keyword in the at least one subject document wherein the significance value of a given keyword is calculated by using a formula based at least on a number of sentences that contain the given keyword in the at least one subject document, a number of sentences in the at least one subject document, a number of sentences contained in all of the electronic documents stored in the storage, and a number of sentences that contain the given keyword in all of the electronic documents stored in the storage;

update the difficulty of each keyword based on the difficulty of the subject document depending on the significance value of the keyword in the at least one subject document; and in response to receipt of, from a computer device over a network, a request for electronic documents based on at least one of keywords and difficulty, retrieve one or more results including one or more electronic documents in satisfaction of the request, and transmit the retrieved results to the computing device.

10. The computer system of claim 9, wherein the processor is further configured to update the difficulty of each subject document by using the updated difficulties of keywords included in the subject document.

11. The computer system of claim 10, wherein the updating of the difficulty of each subject document and each keyword is repeated until a predetermined condition is satisfied.

12. The computer system of claim 9, wherein the formula used to calculate the significance value of the given keyword is:

$$PMI(c, d) = \log\left\{\left(\frac{N(c, d)}{N(c)}\right) \times \left(\frac{N}{N(d)}\right)\right\},$$

wherein c is the given keyword, d is the at least one subject document, N(c,d) is the number of sentences that contain the given keyword in the at least one subject document, N(c) is the number of sentences that contain the given keyword in all of the electronic documents stored in the storage device, N is a number of sentences contained in all of the electronic documents stored in the storage device and N(d) is a number of sentences in the at least one subject document.

13. The computer system of claim 9, wherein the computer system is configured to provide a service in a cloud environment.

14. A program product for using an electronic document retrieval system to retrieve electronic documents having a level of difficulty in satisfaction of an electronic document retrieval request, the program product comprising program codes and a storage medium for recording the program codes readably by a computer processor, and the program codes being executed by the computer processor, the processor configured to:

retrieve at least one subject document from electronic documents stored in a storage;

set a difficulty of each keyword included in the at least one subject document equal to a locality of the keyword in the at least one subject document as an initial value;

estimate a difficulty of the at least one subject document by a statistical processing of the difficulties of the keywords included in the at least one subject document;

calculate a significance value of each keyword in the at least one subject document wherein the significance value of a given keyword is calculated by using a formula based at least on a number of sentences that contain the given keyword in the at least one subject document, a number of sentences in the at least one subject document, a number of sentences contained in all of the electronic documents stored in the storage, and a number of sentences that contain the given keyword in all of the electronic documents stored in the storage;

update the difficulty of each keyword based on the difficulty of the subject document depending on the significance value of the keyword in the at least one subject document; and receive, from a computer device over a network, a request for electronic documents based on at least one of keywords and difficulty, retrieve one or more results including one or more electronic documents in satisfaction of the request, and transmit the retrieved results to the computing device.

15. The program product of claim 14, wherein, the processor is further configured to update the difficulty of each subject document by using the updated difficulties of keywords included in the subject document.

16. The program product of claim 15, wherein the updating of the difficulty of each subject document and each keyword is repeated until a predetermined condition is satisfied.

17. The program product of claim 16, wherein the formula used to calculate the significance value of the given keyword is:

$$PMI(c, d) = \log\left\{\left(\frac{N(c, d)}{N(c)}\right) \times \left(\frac{N}{N(d)}\right)\right\},$$

wherein c is the given keyword, d is the at least one subject document, N(c,d) is the number of sentences that contain the given keyword in the at least one subject document, N(c) is the number of sentences that contain the given keyword in all of the electronic documents stored in the storage, N is a number of sentences contained in all of the electronic documents stored in the storage and N(d) is a number of sentences in the at least one subject document.

18. A computer system comprising a processor configured to execute program codes for using an electronic document retrieval system to retrieve electronic documents having a level of difficulty in satisfaction of an electronic document retrieval request, a memory configured to store the program codes for execution of the program codes by the processor, and a storage device configured to store electronic documents in a storage device, the processor further configured to execute the program codes to:

retrieve a subject document from the storage device;

set a difficulty of each keyword included in the at least one subject document equal to a locality of the keyword in the at least one subject document as an initial value;

estimate difficulty of the subject document by a statistical processing of the difficulties of the keywords included in the subject document;

calculate a significance value of each keyword in the subject document;

update the difficulty of each keyword based on the difficulty of the subject document depending on the significance value of the keyword in the subject document;

repeat the updating of the difficulties of the subject document and each keyword until a predetermined condition is satisfied; and in response to receipt of, from a computer device over a network, a request for electronic documents based on at least one of keywords and difficulty, retrieve one or more results including one or more electronic doe n s in satisfaction of the request, and transmit the retrieved results to the computing device;

wherein the significance value of a given keyword is calculated by using a formula:

$$PMI(c, d) = \log\left\{\left(\frac{N(c, d)}{N(c)}\right) \times \left(\frac{N}{N(d)}\right)\right\},$$

wherein c is the given keyword, d is the subject document, N(c,d) is a number of sentences that contain the given keyword in the subject document, N(c) is a number of sentences that contain the given keyword in all of the electronic documents stored in the storage device, N is a number of sentences contained in all of the electronic documents stored in the storage device and N(d) is a number of sentences in the subject document.

19. A program product for using an electronic document retrieval system to retrieve electronic documents having a level of difficulty in satisfaction of an electronic document retrieval request, the program product comprising program codes and a storage medium for recording the program codes readably by a computer processor, and the program codes being executed by the computer processor, the processor configured to:

retrieve a subject document from the storage device;

set a difficulty of each keyword included in the at least one subject document equal to a locality of the keyword in the at least one subject document as an initial value;

estimate difficulty of the subject document by a statistical processing of the difficulties of the keywords included in the subject document;

calculate a significance value of each keyword in the subject document;

update the difficulty of each keyword based on the difficulty of the subject document depending on the significance value of the keyword in the subject document;

repeat the updating of the difficulties of the subject document and each keyword until a predetermined condition is satisfied; and receive, from a computer device over a network, a request for electronic documents based on at least one of keywords and difficulty, retrieve one or more results including one or more electronic documents in satisfaction of the request, and transmit the retrieved results to the computing device;

wherein the significance value of a given keyword is calculated by using a formula:

$$PMI(c, d) = \log\left\{\left(\frac{N(c, d)}{N(c)}\right) \times \left(\frac{N}{N(d)}\right)\right\},$$

wherein c is the given keyword, d is the subject document, N(c,d) is a number of sentences that contain the given keyword in the subject document, N(c) is a number of sentences that contain the given keyword in all of the electronic documents stored in the storage, N is a number of sentences contained in all of the electronic documents stored in the storage and N(d) is a number of sentences in the subject document.

20. The program product of claim 19, wherein the program product, when executed, causes the computer processor to provide a service in a cloud environment.

* * * * *